US008191557B2

(12) United States Patent
Saiki

(10) Patent No.: US 8,191,557 B2
(45) Date of Patent: Jun. 5, 2012

(54) UNIVERSAL HAIR TAPERING RAZOR AND UNIVERSAL HAIR TAPERING METHOD

(75) Inventor: Koji Saiki, Koshigaya (JP)

(73) Assignee: Nittchoyamato Co., Ltd., Koshigaya-shi (JP)

( * ) Notice: Subject to any disclaimer, the term of this patent is extended or adjusted under 35 U.S.C. 154(b) by 408 days.

(21) Appl. No.: 12/577,932

(22) Filed: Oct. 13, 2009

(65) Prior Publication Data

US 2010/0294295 A1 Nov. 25, 2010

(30) Foreign Application Priority Data

May 21, 2009 (JP) ..... 2009-123410

(51) Int. Cl.
*A45D 24/34* (2006.01)
*A45D 7/00* (2006.01)

(52) U.S. Cl. ..... 132/213; 132/200

(58) Field of Classification Search ..... 132/213.1, 132/214, 213; 30/53, 30, 31, 47, 54, 55, 30/57
See application file for complete search history.

(56) References Cited

U.S. PATENT DOCUMENTS

| | | | | |
|---|---|---|---|---|
| 1,003,749 | A * | 9/1911 | Jannert | 30/78 |
| 1,852,362 | A * | 4/1932 | Newby | 132/149 |
| 3,456,340 | A * | 7/1969 | Mondiello | 30/30 |
| 4,037,322 | A * | 7/1977 | Bresler | 30/53 |
| 4,454,653 | A | 6/1984 | Chen | |
| D302,344 | S * | 7/1989 | Baker | D28/45 |
| 4,955,136 | A | 9/1990 | Diaz-Rivera | |
| 5,649,364 | A * | 7/1997 | Ilanlou | 30/40.2 |
| 5,908,036 | A | 6/1999 | Andrews | |
| 6,092,288 | A | 7/2000 | Adachi | |
| 2004/0237313 | A1 | 12/2004 | Tanaka | |
| 2005/0044723 | A1 | 3/2005 | Sato | |

FOREIGN PATENT DOCUMENTS

| | | |
|---|---|---|
| DE | 27 21 421 | 11/1978 |
| FR | 531 538 | 1/1922 |
| JP | 54928 | 1/1921 |
| JP | 3000004 U | 4/1994 |
| JP | 6-292771 | 10/1994 |
| JP | 2003-326001 | 11/2003 |
| JP | 2006-212249 | 8/2006 |

OTHER PUBLICATIONS

Takigawa Catalog vol. 33, htttp://www.takigawa.co.jp, 3 pages.
Office Action issued Mar. 15, 2011, in Japanese Patent Application No. 2009-123410 with English translation.
Extended European Search Report issued Sep. 10, 2010 in EP 09 01 2830.
European Search Report issued Apr. 17, 2012 in European Application No. 12001002.0.

* cited by examiner

*Primary Examiner* — Robyn Doan
(74) *Attorney, Agent, or Firm* — Oblon, Spivak, McClelland, Maier & Neustadt, L.L.P.

(57) ABSTRACT

A universal hair tapering razor for tapering hair includes a cutting blade portion, a shank portion and a handle portion, the cutting blade portion including blade means having a cutting blade with a cutting edge for tapering hair, tapering regulating means, and blade holding means having a flat portion which comes into close contact with the panel of hair to be tapered, with the cutting edge and the outer surface of the flat portion both being on an identical reference plane, and the cutting blade is disposed at an angle θ1 in the range of $0° < \theta 1 \leqq 40°$ with respect to the reference plane, and the handle portion is disposed at an angle θ2 in the range of $10° \leqq \theta 2 \leqq 40°$ with respect to the cutting blade portion. There is also provided a universal hair tapering method of tapering hair that can create two or more different types of hairstyles as desired from one type of hair tapering, which method can be performed with this hair tapering razor.

13 Claims, 14 Drawing Sheets

UNIVERSAL HAIR TAPERING RAZOR AND UNIVERSAL HAIR TAPERING METHOD

BACKGROUND OF THE INVENTION

1. Field of the Invention

The present invention relates to a hair tapering razor for hair tapering that can create two or more different types of hairstyles as desired from one type of hair tapering, and which can be used in a hair salon, in a barbershop, or at home. The present invention also relates to a method of performing such hair tapering.

2. Discussion of the Background

A hair cut razor is one of the indispensable tools used in beauty and barber technology in order to cut hair to a desired length or to adjust hair volume, or to perform both simultaneously to the strands of hair for various hairstyles.

FIG. 1 and FIG. 2 show conventional razors for such hair cutting now in general use. The razor as shown in FIG. 1 is composed of a cutting blade portion including a disposable keen-edged blade and a handle that can be folded on a pivot so as to insert the edged blade into the handle, which serves as a holder for the edged blade as well. The razor as shown in FIG. 2 is of a stick type, which is composed of a cutting blade portion, including a disposable edged blade, and a handle extending straight from one end of the cutting blade portion.

Various hair cut techniques using any of the above-mentioned conventional razors are presently known and used in practice, such as tapering cut, thinning cut, and pointing cut. As long as the above-mentioned razors are used, however, special training and skill is necessary for performing such hair cut techniques. This is partly because, when any of the razors as shown in FIG. 1 and FIG. 2 is used, the razor has to be held in a rather peculiar rigid posture, which strains the hand, the wrist and the arm of the operator, as shown in FIG. 3A and FIG. 3B. Even a skilled professional, when such a posture is used repeatedly and/or continuously for a long period of time, can suffer from inflammation of the tendon sheath, which is known as the occupational disease of professional hairdressers. This is a significant shortcoming of the conventional hair razors now in general use.

The above-mentioned conventional hair taper cutting technique is used for to the completion of only one hairstyle, and therefore it is very partial and restrictive in terms of the range of the application of the technique. Furthermore, by the conventional taper cut technique, it is almost impossible to repeat the same taper cut, and therefore the reproducibility of one hair taper cut is extremely low.

Thus, there has not been known a technique of hair taper cuffing that can create two or more different types of hairstyles from only one type of hair tapering, with excellent reproducibility of the taper cut. Further, a razor for such a taper cut has not been known, either.

SUMMARY OF THE INVENTION

It is therefore a first object of the present invention to provide a razor for performing hair tapering while satisfying the following four requirements (hereinafter referred to as "universal hair tapering razor"), whereby there can be achieved such hair tapering that can create two or more different types of hairstyles as desired from one type of hair tapering, and that can be performed in a hair salon, barbershop, or at home, without requiring any particular skill, technique or training (hereinafter referred to as "universal hair tapering"):

(1) tapering can be performed with a predetermined constant blade angle to the surface of a panel of hair to be tapered in each tapering stroke;

(2) each hair can be tapered so as to have a predetermined cut angle at the cut end portion thereof;

(3) each hair can be tapered so as to have a smooth cut surface at the cut end portion thereof; and (4) the above tapering can be performed under the same conditions in any tapering direction to all of hairs on the head, the average overall number of which is as many as about 100,000.

The second object of the present invention is to provide a universal hair tapering razor for performing the above-mentioned universal hair tapering without causing the operator to feel any strain in the hand, the wrist and the arm, by holding the razor in a natural relaxed posture, without requiring any special skill, technique or training, but by simple movement of the body in the tapering direction, while maintaining the equilibrium of the operator.

The third object of the present invention is to provide a method of universal hair tapering that can create two or more different types of hairstyles from one type of hair tapering as desired.

The above-mentioned first and second objects of the present invention can be achieved by the following universal hair tapering razor of the present invention.

The universal hair tapering razor of the present invention includes (1) a cutting blade portion, (2) a shank portion connected to one end of the cutting blade portion, and (3) a handle portion connected to the cutting blade portion via the shank portion, wherein:

the cutting blade portion includes (a) blade means including a cutting blade that includes a cutting edge for tapering hair by cutting the hair with a predetermined angle, which cutting blade is configured to stroke a panel of hair to be tapered in a direction of hair growth, which direction is referred to as hair tapering direction; (b) tapering regulating means for regulating hair tapering including a tapering regulating member disposed along the cutting blade, with a plurality of projecting edges projecting out over the cutting edge of the cutting blade at predetermined intervals for allowing the cutting edge to come into contact with hair to be tapered at the predetermined intervals corresponding to the intervals of the projecting edges; and (c) blade holding means for holding the blade means, the blade holding means including a flat portion that extends in parallel with the cutting blade in the longitudinal direction thereof and configured to be brought into close contact with the panel of hair to be tapered, with both the cutting edge of the cutting blade and the outer surface of the flat portion being configured so as to be on an identical reference plane, wherein an angle $\theta 1$ of the cutting blade directed to the reference plane is defined as an angle directed from the reference plane to a central plane of the cutting blade that passes through a longitudinal center line of a back of the cutting blade and the cutting edge, measured upstream of the hair tapering direction with respect to the cutting blade portion, in a direction normal to the cutting edge of the cutting blade, the angle $\theta 1$ of the cutting blade is in the range of $0° < \theta 1 \leqq 40°$; and the handle portion is disposed downstream of the tapering direction, forming an angle $\theta 2$ in the range of $10° \leqq \theta 2 \leqq 40°$ between a longitudinal center line of the cutting blade portion and a longitudinal center line of the handle portion, when measured on the central plane of the cutting blade.

The third object of the present invention can be achieved by the following universal hair tapering method:

The method includes the steps of:

(1) forming a first hair panel in such a manner that the bottom of the first hair panel forms a slanting angle in a range of 35° to 55° with respect to a vertical line, either in a right direction or in a left direction by making equal the length of each hair in the first hair panel in a tapering direction that is directed from the bottom of the first hair panel to a top thereof, that is, in the direction of hair growth;

(2) making uniform a front surface of the first hair panel while applying tension to the first hair panel in the tapering direction;

(3) arranging (a) blade means including a cutting blade that includes a cutting edge for tapering hair by cutting hair with a predetermined angle and (b) tapering regulating means for regulating hair tapering which allows the cutting edge to come into contact with the front surface of the first hair panel at predetermined intervals, both the blade means and the tapering regulating means being set in parallel with the bottom of the first hair panel, and bringing the cutting blade into close contact with the front surface of the first hair panel, and providing, on the back side of the first hair panel, supporting means for supporting the blade means and the tapering regulating means via the first hair panel so as to cause the blade means and the tapering regulating means to operate under a predetermined constant condition during the movement of the blade means and the tapering regulating means;

(4) moving the cutting blade means in the tapering direction from the bottom of the first hair panel to the top thereof, with the cutting edge kept in close contact with the front surface of the first hair panel with a slanting angle of $\theta 1$ in a range of $0° < \theta 1 \leqq 40°$ with respect to the front surface of the first hair panel when measured in a direction normal to a longitudinal direction of the cutting edge of the cutting blade, thereby tapering each hair with a constant cutting angle and a smooth cut surface;

(5) forming a plurality of hair panels successively, with the bottom of each hair panel being set in parallel to the bottom of the first hair panel, in the same manner and in the same direction as that of the first hair panel so as to cover an entire hairstyling region to be subjected to a desired hair styling, while performing the same steps as the steps (1) to (4) for each of the hair panels;

(6) forming a second hair panel in such a manner that the bottom of the second hair panel forms a slanting angle in a range of 35° to 55° with respect to a vertical line in an opposite direction to the direction of the bottom of the first hair panel in the same manner as in step (1); and (7) forming a plurality of hair panels successively, with the bottom of each hair panel being set in parallel to the bottom of the second hair panel, in the same manner and in the same direction as that of the second hair panel so as to cover the entire hairstyling region, while performing the same steps as the steps (1) to (4) for each of the hair panels.

The above-mentioned universal hair tapering method can be securely performed by use of the universal hair tapering razor of the present invention.

DETAILED DESCRIPTION OF THE PREFERRED EMBODIMENTS

Figure 1:
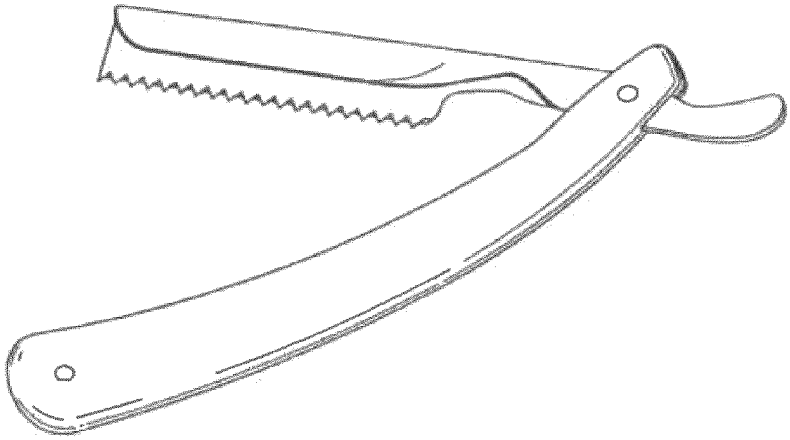
FIG. 1 is a perspective view of a conventional folding razor with a disposable blade.

A preferred embodiment of the universal hair tapering razor of the present invention includes (1) a cutting blade portion; (2) a shank portion connected to one end of the cutting blade portion, and (3) a handle portion connected to the cutting blade portion via the shank portion, wherein:

the cutting blade portion includes (a) blade means including a cutting blade that includes a cutting edge for tapering hair by cutting the hair with a predetermined angle, which cutting blade is configured to stroke a panel of hair in a direction of hair growth, which direction is referred to as the hair tapering direction; (b) tapering regulating means for regulating hair tapering including a tapering regulating member, disposed along the cutting blade, with a plurality of projecting edges projecting out over the cutting edge of the cutting blade at predetermined intervals for allowing the cutting edge to come into contact with the panel of hair to be tapered at the predetermined intervals corresponding to the intervals of the projecting edges; and (c) blade holding means for holding the blade means, including a flat portion that extends in parallel with the cutting edge in the longitudinal direction thereof and configured to be brought into close contact with the panel of hair to be tapered, with both the cutting edge of the cutting blade and the outer surface of the flat portion being configured so as to be on an identical reference plane, wherein an angle θ1 of the cutting blade with respect to the reference plane is defined as an angle directed from the reference plane to a central plane that passes through a longitudinal center line of a back of the cutting blade and the cutting edge thereof, measured upstream of the hair tapering direction with respect to the cutting blade portion, in a direction normal to the cutting edge of the cutting blade, and the angle θ1 of the cutting blade is in the range of $0° < \theta 1 \leqq 40°$; and the handle portion is disposed so as to be directed downstream of the tapering direction, forming an angle θ2 in a range of $10° \leqq \theta 2 \leqq 40°$ between a longitudinal center line of the cutting blade portion and a longitudinal center line of the handle portion, when measured on the central plane of the cutting blade that passes through the longitudinal center line of the back of the cutting blade and the cutting edge of the cutting blade.

In the above-mentioned embodiment of the universal hair tapering razor, the blade holding means may be configured so as to includes a datum shoulder portion and a counterpart shoulder portion, which two shoulder portions are disposed so as to face each other at the above-mentioned central plane of the cutting blade and integrally hold therebetween the blade means and the tapering regulating means, and the datum shoulder portion includes the above-mentioned flat portion.

In this embodiment, the side of the datum shoulder portion in which the flat portion is formed is referred to as a back side of the universal hair tapering razor, while the opposite side where the counterpart shoulder portion is formed is referred to as a front side of the universal hair tapering razor.

Furthermore, the handle portion includes a flat surface portion on the front side of the universal hair tapering razor, with the outer surface of the front surface portion of the handle slanting, forming an angle θ3 in the range of $0° < \theta 3 \leqq 40°$ with the reference plane, when measured upstream of the hair tapering direction with respect to the cutting blade portion, in the direction normal to the cutting edge of the cutting blade.

In this universal hair tapering razor, the blade means and the tapering regulating means may be configured to as to detachable from the datum shoulder portion and the counterpart shoulder portion.

Figure 4A:
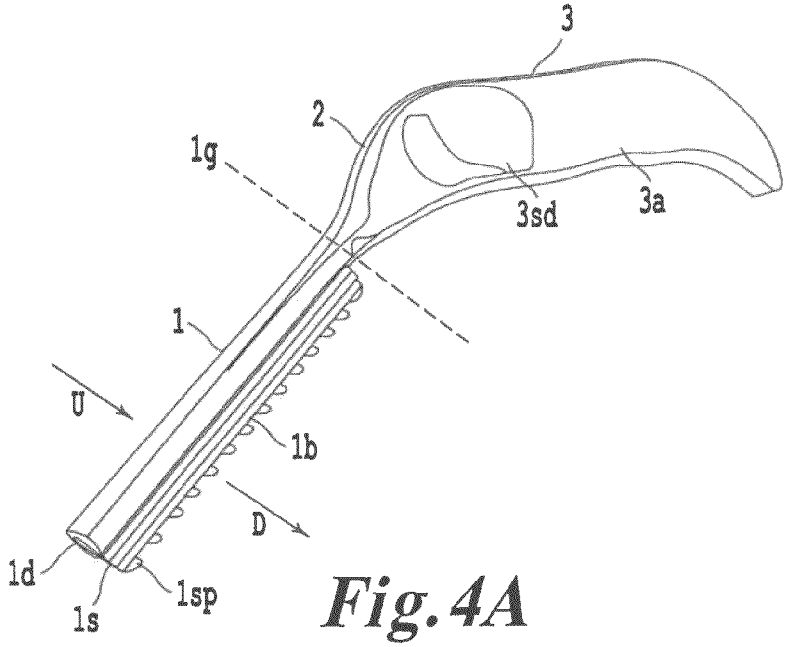
FIG. 4A is a perspective view of a front side of an embodiment of the universal hair tapering razor.
Figure 4B:
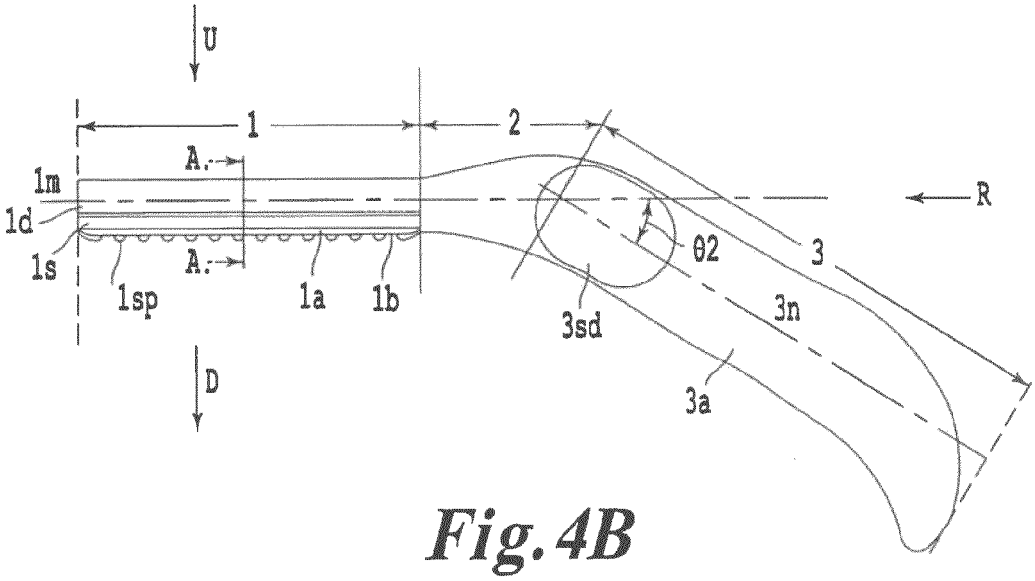
FIG. 4B is a plan view of the front side of the embodiment of the universal hair tapering razor shown in FIG. 4A.

FIG. 4A is a perspective view of a front side of the embodiment of the universal hair tapering razor. In FIG. 4A, reference numeral 1 indicates the cutting blade portion; reference numeral 2, the shank portion; and reference numeral 3, the handle portion. FIG. 4B is a plan view of the front side of the embodiment of the universal hair tapering razor shown in FIG. 4A. As shown in FIG. 4A and FIG. 4B, the embodiment of the universal hair tapering razor includes the cutting blade portion 1, the shank portion 2 connected to one end of the cutting blade portion 1, and the handle portion 3 connected to the cutting blade portion 1 via the shank portion 2.

Figure 5A:
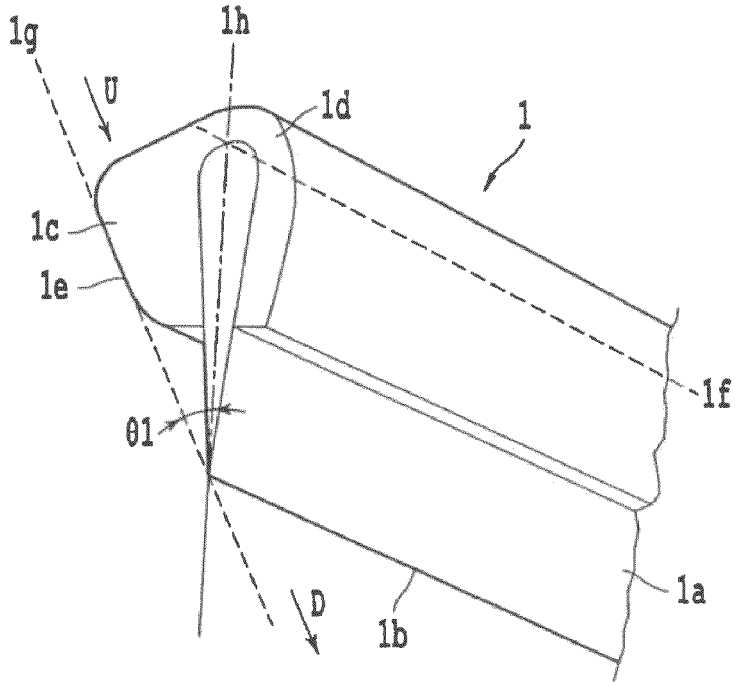
FIG. 5A is a partial perspective view of the top portion on the front side of a cutting blade portion of the embodiment of the universal hair tapering razor shown in FIG. 4A, from which a tapering regulating member 1*s* is omitted for convenience of the explanation.

FIG. 5A is a partial perspective view of the top portion on the front side of the cutting blade portion 1 of the embodiment of the universal hair tapering razor shown in FIG. 4A. In FIG. 5A, a tapering regulating member 1*s*, which is to be disposed along the cutting blade 1*b* as will be explained, is here omitted for convenience of the explanation.

Figure 5B:
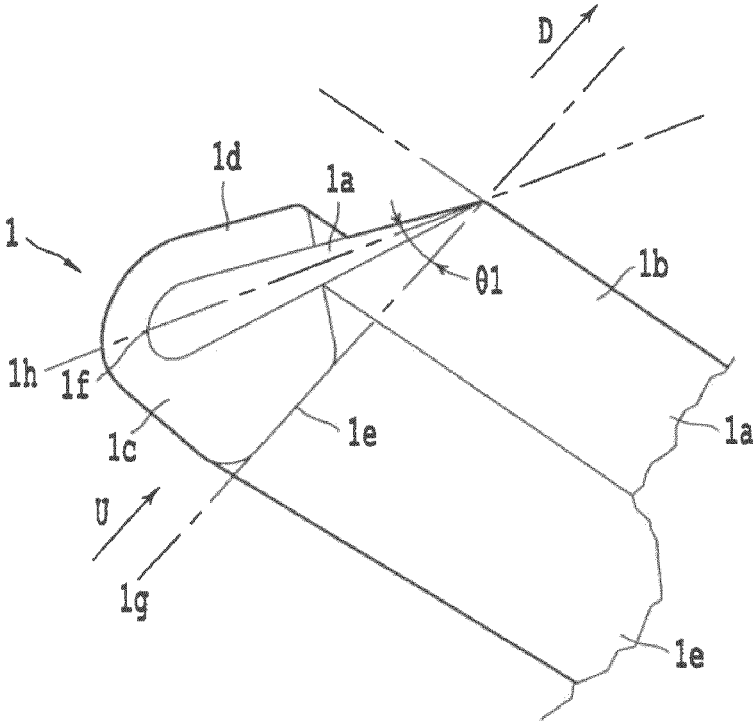
FIG. 5B is a partial perspective view of the top portion on the back side of the cutting blade portion of the embodiment of the universal hair tapering razor shown in FIG. 4A, from which the tapering regulating member 1*s* is omitted for convenience of the explanation.

FIG. 5B is a partial perspective view of the top portion on the back side of the cutting blade portion 1 of the embodiment of the universal hair tapering razor shown in FIG. 4A, from which the tapering regulating member 1*s* is also omitted for convenience of the explanation.

Figure 5C:
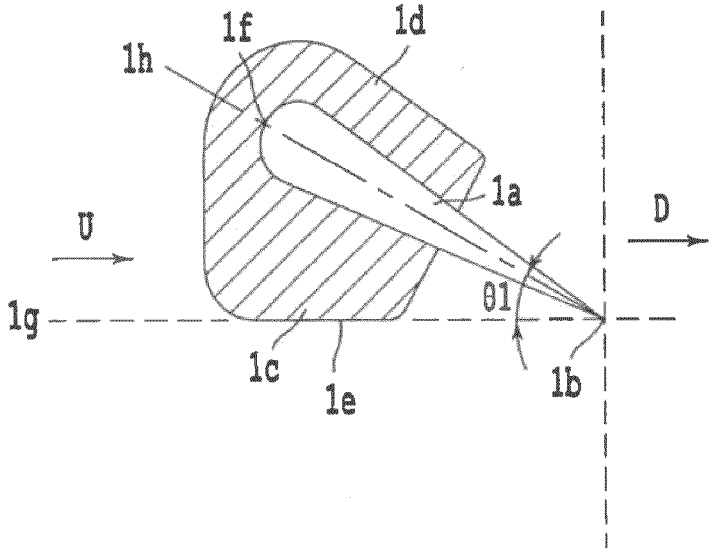
FIG. 5C is a schematic partial cross sectional view of the cutting blade portion taken on line A-A of FIG. 4B, from which the tapering regulating member 1*s* is omitted for convenience of the explanation.

FIG. 5C is a partial cross sectional view of the cutting blade portion 1 taken on line A-A of FIG. 4B, from which the tapering regulating member 1*s* is also omitted for convenience of the explanation.

As shown in FIG. 5A, FIG. 5B and FIG. 5C, the cutting blade portion 1 includes a datum shoulder portion 1*c* and a counterpart shoulder portion 1*d*, which two shoulder portions are disposed so as to face each other at the central plane 1*h* of the cutting blade 1*a* and integrally hold therebetween the tapering regulating member 1*s* (omitted in these figures) and the cutting blade 1*a* so as to direct the cutting edge 1*b* of the cutting blade 1*a* in the hair tapering direction as indicated by arrow U directed to arrow D. U indicates the area upstream of the hair tapering direction with respect to the cutting blade portion 1, and D indicates the area downstream of the hair tapering direction with respect to the cutting blade portion 1.

The datum shoulder portion 1*c* includes a flat portion 1*e* which extends along the cutting blade 1*a* in the longitudinal direction thereof and configured to be brought into close contact with the panel of hair to be tapered, with both the cutting edge 1*b* of the cutting blade 1*a* and the outer surface of the flat portion 1*e* being configured so as to be on an identical reference plane 1*g*. When an angle θ1 of the cutting blade 1*a* directed to the reference plane 1*g* is defined as the angle from (a) the reference plane 1*g*, to (b) a central plane which passes through the longitudinal center line 1*f* of the back of the cutting blade 1*a*, as shown in FIG. 5A, and passes through the cutting edge 1*b* of the cutting blade 1*a*, measured upstream of the hair tapering direction as shown by reference symbol U in FIG. 5A through FIG. 5C with respect to the cutting blade portion 1, in the direction normal to the cutting edge 1*b* of the cutting blade 1*a*, the angle θ1 of the cutting blade 1*a* is in the range of $0° < \theta 1 \leqq 40°$.

As shown in FIG. 4A and FIG. 4B, the handle portion 3 is disposed downstream of the hair tapering direction with respect to the longitudinal center line 1*m* of the cutting blade portion 1, forming an angle θ2 in the range of 10°≦θ2≦40° between the longitudinal center line 1*m* of the cutting blade portion 1 and the longitudinal center line 3*n* of the handle portion 3, when measured on the plane of the central plane 1*h* (shown in FIG. 5A), which passes through the longitudinal center line 1*f* of the back of the cutting blade 1*a* and the cutting edge 1*b* of the cutting blade 1*a*.

Furthermore, as shown in FIG. 4A and FIG. 4B, there is formed a shallow depression 3*sd* on the front surface 3*a* of the handle portion 3 so that the operator can place his or her thumb at a predetermined right position and hold the handle portion 3 rightly.

Figure 5D:
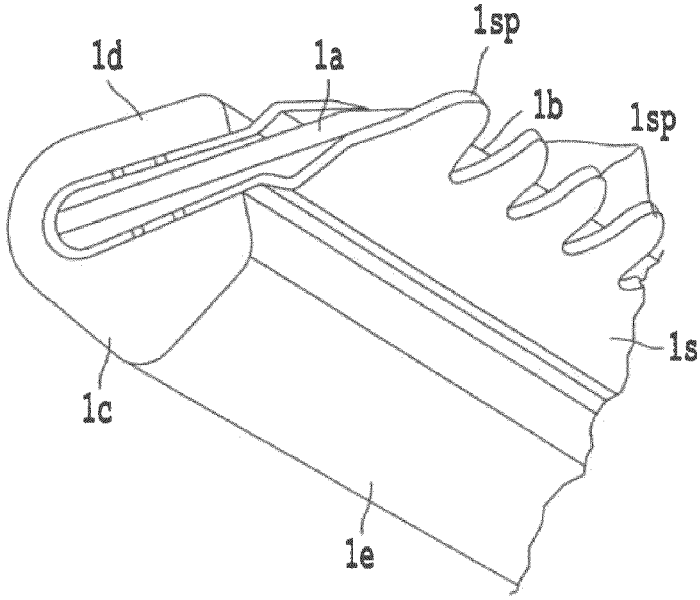
FIG. 5D is a partial perspective view of the top portion on the back side of the cutting blade portion of the embodiment of the universal hair tapering razor, corresponding to FIG. 5B, in which the tapering regulating member 1*s* is shown.

FIG. 5D is a partial perspective view of the top portion on the back side of the cutting blade portion 1 of the embodiment of the universal hair tapering razor, corresponding to FIG. 5B, in which there is shown the tapering regulating member 1*s* disposed along the cutting blade 1*a*. As shown in FIG. 5D, the tapering regulating member 1*s* has a plurality of projecting edges 1*sp* projecting out over the cutting edge 1*b* of the cutting blade 1*a* at predetermined intervals, thereby making it possible to allow the cutting edge 1*b* of the cutting blade 1*a* to come into contact with the hair to be tapered at the predetermined intervals, and hair tapering is successively performed at the same intervals as the cutting blade portion 1 is moved in the tapering direction, that is, from upstream to downstream of the cutting blade portion 1 as indicated by arrow U to arrow D in FIG. 4A and FIG. 4B.

Figure 6A:
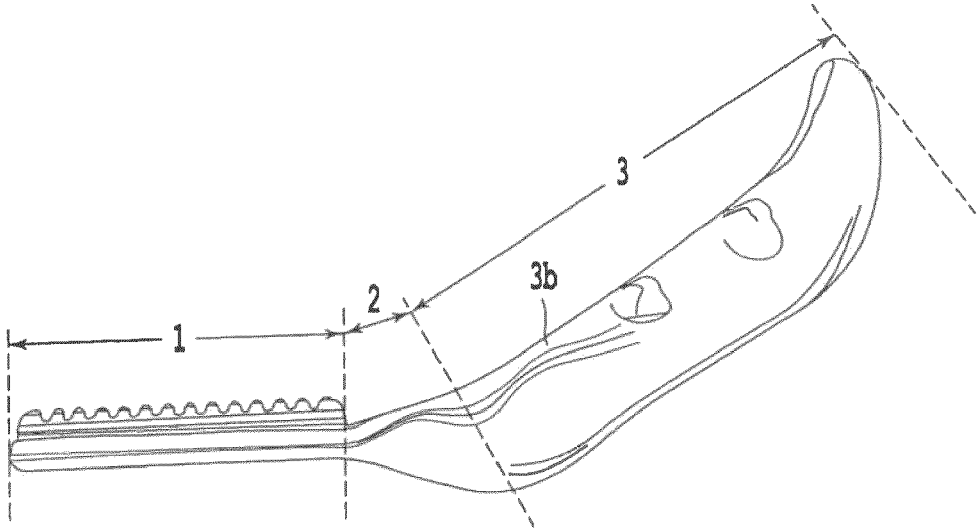
FIG. 6A is a perspective view of a back side of the embodiment of the universal hair tapering razor shown in FIG. 4A.

FIG. 6A is a perspective view of a back side of the embodiment of the universal hair tapering razor shown in FIG. 4A and FIG. 4B.

As shown in FIG. 6A, on the back side 3*b* of the handle portion 3, there are formed a plurality of low projections in order that the operator can touch them and can easily recognize the right positions of his or her forefinger, middle finger, ring finger and little finger. These projections correspond to the previously mentioned shallow depression 3*sd* formed on the front side 3*a* of the handle portion 3 on which the operator can rightly place his or her thumb.

Figure 6B:
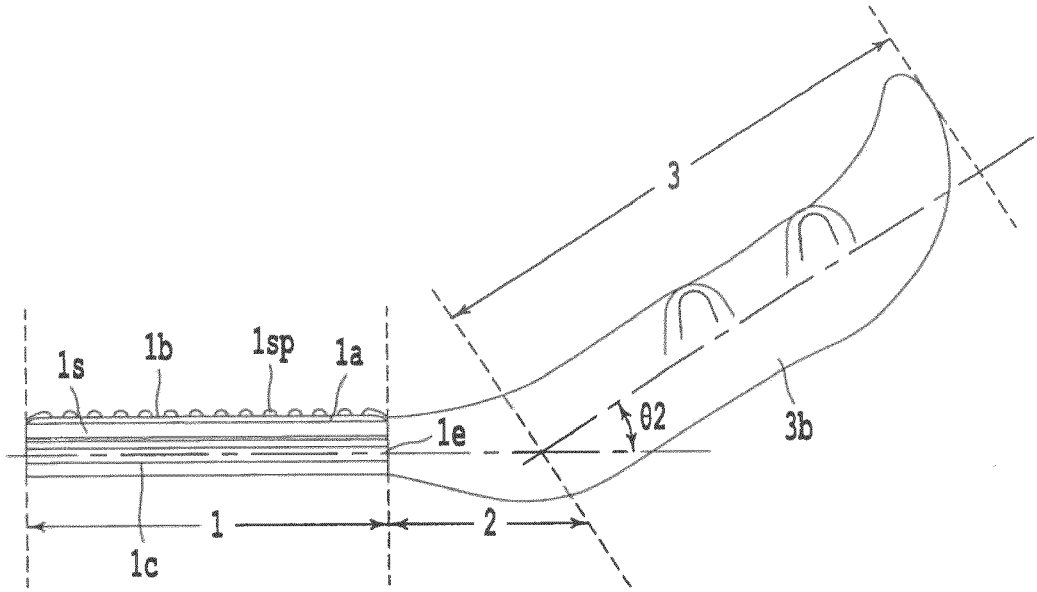
FIG. 6B is a plan view of the back side of the embodiment of the universal hair tapering razor shown in FIG. 4A.

FIG. 6B is a plan view of the back side of the embodiment of the universal hair tapering razor shown in FIG. 4A.

As shown in FIG. 6B, the flat portion 1*e* of the datum shoulder portion 1*c* extends in parallel with the cutting edge 1*b* of the cutting blade 1*a* in the longitudinal direction thereof.

Figure 7A:
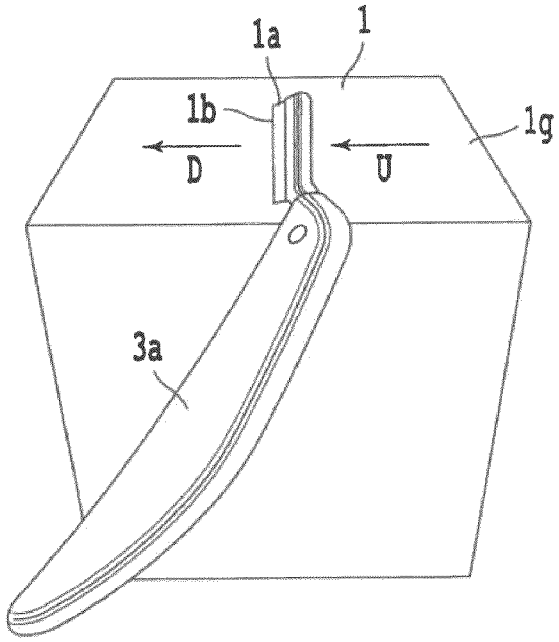
FIG. 7A is a perspective view of the embodiment of the universal hair tapering razor shown in FIG. 4A, when viewed in the direction of Arrow R in FIG. 4B.

FIG. 7A is a perspective view of the embodiment of the universal hair tapering razor shown in FIG. 4A, when viewed in the direction of Arrow R in FIG. 4B.

Figure 7B:
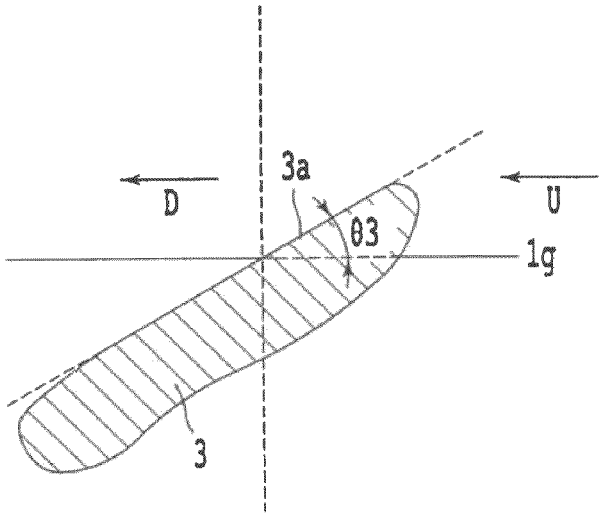
FIG. 7B is a schematic cross sectional side view of the embodiment of the universal hair tapering razor shown in FIG. 4A, when viewed in the direction of arrow R in FIG. 4B.

FIG. 7B is a schematic cross sectional side view of the embodiment of the universal hair tapering razor shown in FIG. 4A, when viewed in the direction of arrow R in FIG. 4B.

As shown in FIG. 7A and FIG. 7B, in the universal hair tapering razor, the handle portion 3 includes a flat surface portion on the front side thereof 3*a*, and the outer surface of the front surface portion 3*a* may slant with respect to the above-mentioned reference plane 1*g* for the easiness of the tapering operation, preferably with an angle θ3 in the range of 0°<θ3≦40° when measured upstream of the hair tapering direction (as indicated with arrow U) with respect to the cutting blade portion 1, in the direction normal to the cutting edge 1*b* of the cutting blade 1*a*.

Figure 8:
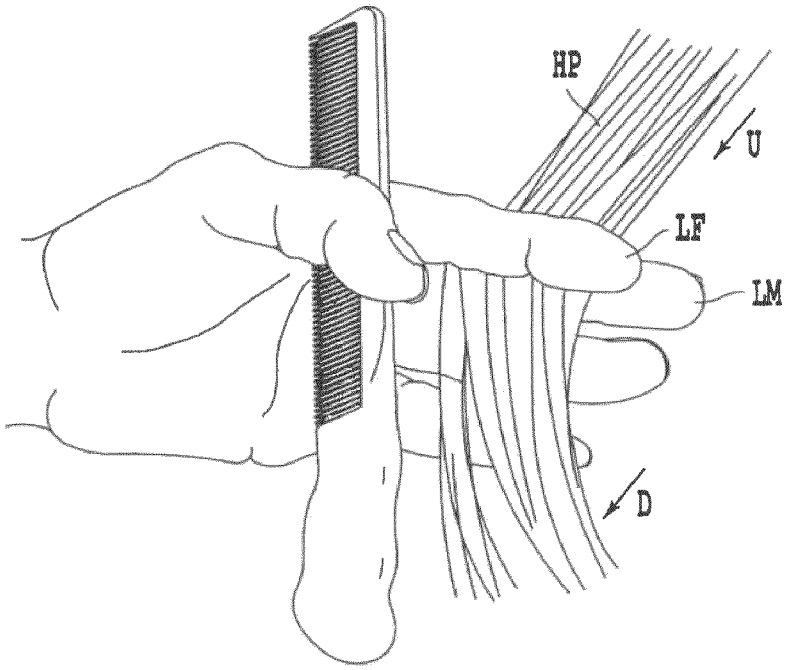
FIG. 8 is a view in explanation of the step of forming a panel of hair to be tapered by use of the universal hair tapering razor.

When the universal hair tapering is performed by use of the universal hair tapering razor, a panel of hair HP to be tapered is taken between the middle finger of the left hand LM and the forefinger of the left hand LF as shown in FIG. 8.

Figure 9A:
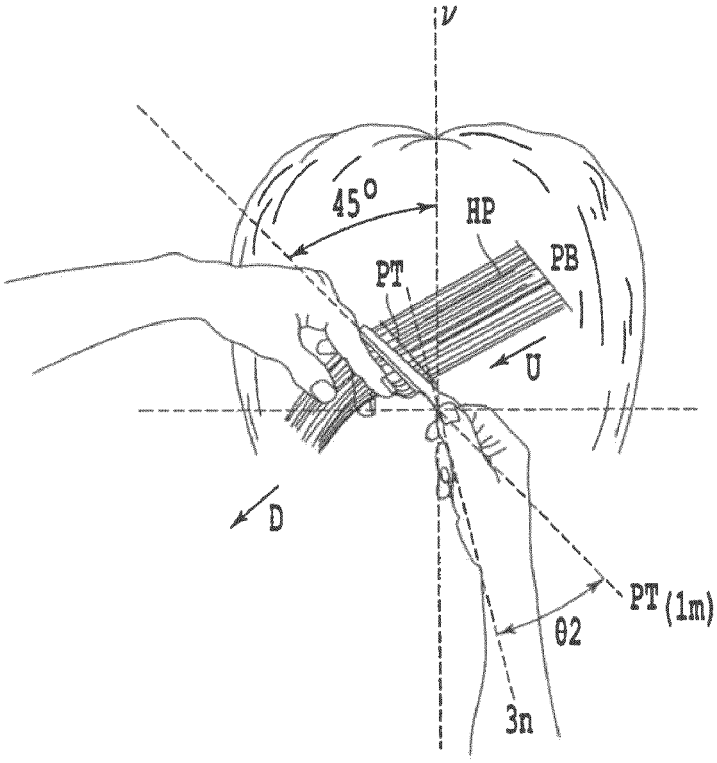
FIG. 9A and FIG. 9B are views in explanation of an example of the universal hair tapering operation performed by use of the universal hair tapering razor.
Figure 9B:
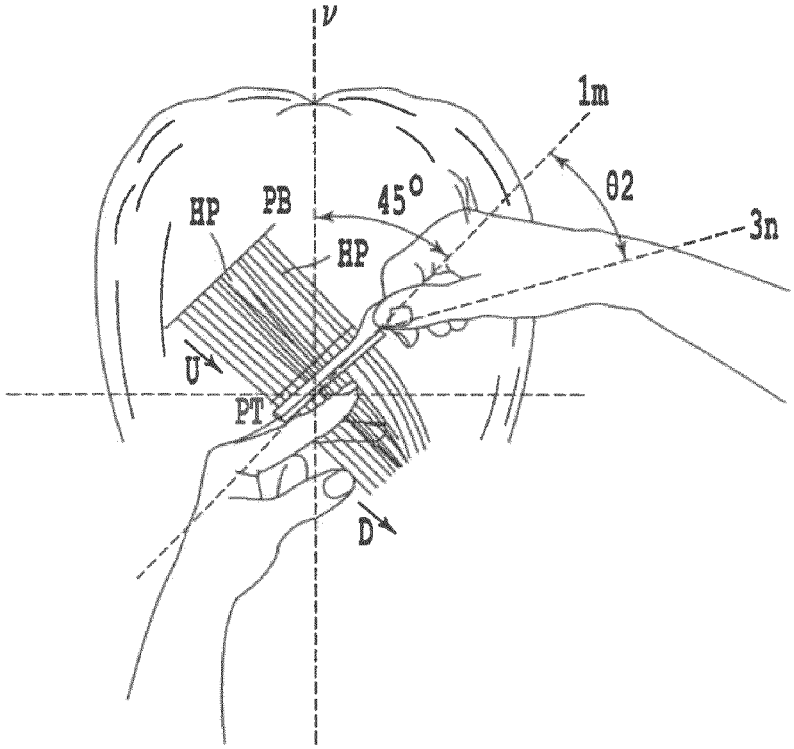

As shown in FIG. 9A or FIG. 9B, with the posture of the head being held upright, a hair panel HP to be tapered is formed by use of a comb by setting the bottom PB of the hair panel HP downward, either to the left side or to the right side, for example, with an angle of 45° with respect to a vertical line V and by making equal the length of each hair in the hair panel HP from the bottom PB of the hair panel HP to the top PT of the hair panel HP.

Figure 10A:
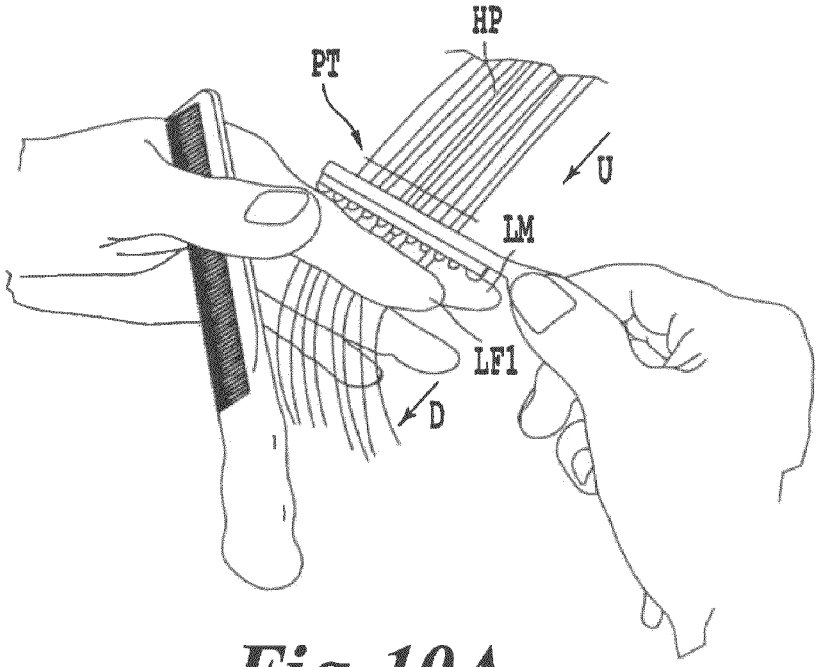
FIG. 10A is a detailed view in explanation of the tapering step in the universal hair tapering operation performed by use of the universal hair tapering razor.

FIG. 10A shows the step of tapering the thus formed hair panel HP with the angle θ1 of the cutting blade 1*a* kept constant in the range of 0°<θ1≦40° towards the top PT of the hair panel HP, that is, in the direction of hair growth. As mentioned above, the bottom PB of the hair panel HP can be set, either to the left side or to the right side, for example, with an angle of 45° with respect to the vertical line V, and the tapering is performed with the application of an appropriate tension in the direction from the bottom PB of the hair panel HP to the top PT of the hair panel HP, that is, in the direction of hair growth.

Figure 10B:
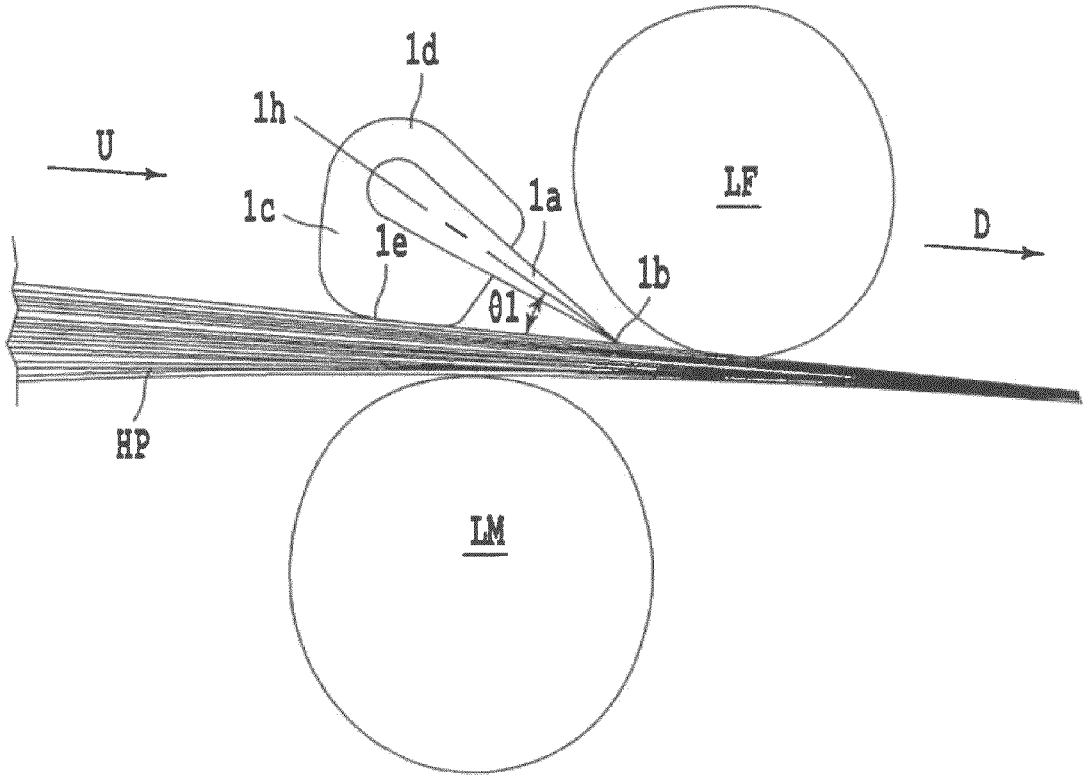
FIG. 10B is a schematic cross sectional view in explanation of the principle of the universal hair tapering operation when performed in practice by use of the universal hair tapering razor, from which the tapering regulating member 1*s* is omitted for convenience of the explanation.

FIG. 10B is a schematic cross sectional view in explanation of the principle of the universal hair tapering operation when performed in practice by use of the universal hair tapering razor, from which the tapering regulating member 1*s* is omitted for convenience of the explanation.

As mentioned above, in the universal hair tapering by use of the universal hair tapering razor, as shown in FIG. 10B, the flat portion 1*e* of the datum shoulder portion 1*c* of the cutting blade portion 1 is brought into close contact with the front surface of the hair panel HP with the application of a tension to the hair panel HP in the direction from arrow U to arrow D, that is, in the direction of hair growth, and simultaneously the forefinger LF of the left hand is placed on the front surface of the hair panel HP downstream of the cutting blade portion 1 in terms of the hair tapering direction, and is brought into close contact with the front surface of the hair panel HP, while the back side of the hair panel HP is held with the middle finger LM of the left hand. Then with the blade edge 1*b* being in contact with the front surface of the hair panel HP, and with the handle portion being gripped with the right hand, the cutting blade portion 1 is moved in the tapering direction, that is, in the direction from arrow U to arrow D. In this tapering operation, the flat portion 1*e* of the datum shoulder portion 1*c* serves to make uniform the front surface of the hair panel HP to be tapered and to keep constant the angle θ1 of the cutting blade 1*a* directed to the front surface of the hair panel HP, and also to keep constant the tapering conditions in collaboration with the middle finger LM of the left hand which supports the back side of the hair panel HP during the tapering operation, whereby when the universal hair tapering razor is used, the tapering can be carried out with the angle θ1 of the cutting blade 1*a* directed to the hair panel HP kept constant in the hair panel in any desired length.

Figure 13:
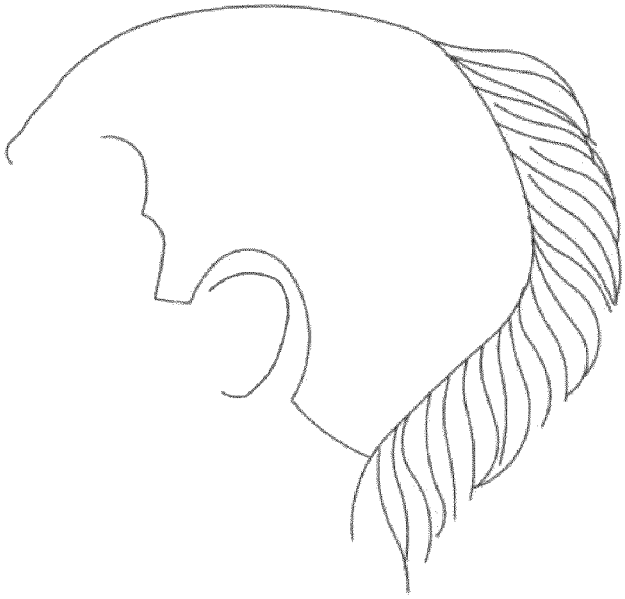
FIG. 13 is a schematic view of continuous-smooth line-shaped contours of the tops of the panels of hair formed by the universal hair tapering conducted by use of the universal hair tapering razor, in which each panel of hair was tapered from either side, that is, from the right side to the left side, and from the left side to the right side, or vice versa, in the entire hair of the head.

In the universal hair tapering by use of the universal hair tapering razor, when the above-mentioned tapering operation is carried out for each hair panel of the head, in the left direction and then in the right direction, or vice versa, as shown in FIG. 9A and FIG. 9B, with the angle θ1 of the cutting blade 1*a* kept constant in the range of 0°<θ1≦40°, the tops of the hair panels are arrayed on a continuous smooth line as shown in FIG. 13, which arrangement is extremely suitable for creating various hairstyles. For this purpose, it is preferable that the angle θ1 of the cutting blade 1*a* be in the range of 10°≦θ1≦35°, more preferably in the range of 20°≦θ1≦32°, further more preferably in the range of 28.5°<θ1≦29.5°. When the angle θ1 of the cutting blade 1*a* is out of the range of 0°<θ1≦40°, for example, when the angle θ1 of the cutting blade 1*a* is 45°, there cannot be obtained such a continuous smooth line formed by the tops of the hair panels as shown in FIG. 13, since at least one of the previously mentioned four requirements for the universal tapering cannot be met, and as a matter of course, various hairstyles cannot be created.

Figure 10C:
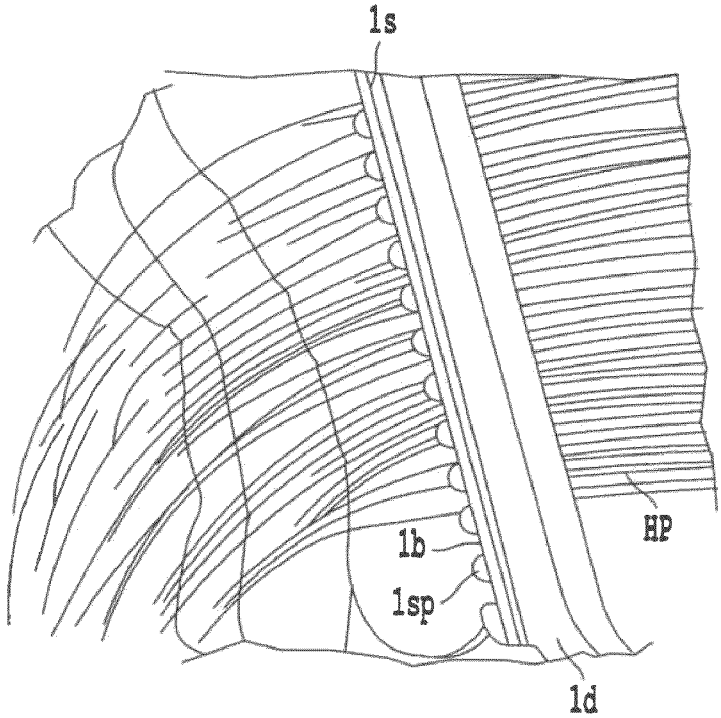
FIG. 10C is a perspective view in explanation of the function of the tapering regulating member attached to the cutting blade of the universal hair tapering razor.

As shown in FIG. 5D, the tapering regulating member 1*s* is disposed along the cutting edge 1*b* of the cutting blade 1*a*, whereby when the above-mentioned tapering operation is carried out as shown in FIG. 10C, the cutting edge 1*b* comes into contact with the hair panel at the intervals corresponding to the intervals of the projecting edges 1*sp* of the tapering regulating member 1*s* so that the tapering is regulated at the predetermined intervals. It is preferable that the space between the tops of the adjacent projecting edges 1*sp* of the tapering regulating member 1*s* be about 4 mm, and the width of each portion of the cutting edge 1*b* between the adjacent projecting edges 1*sp* which actually comes into contact with hair be about 2 mm, and the height of each projecting edge 1*sp* measured from the cutting edge 1*b* to the top of the projecting edge 1*sp* be about 1 mm.

Furthermore, in the universal hair tapering by use of the universal hair tapering razor, as shown in FIG. 9A and FIG. 9B, when the bottom PB of the hair panel is formed, for example, with an angle of 45° with respect to the vertical line V, the posture of the left hand and right hand is exactly the same either when the bottom PB of the hair panel is formed in the left downward direction or when the bottom PB of the hair panel is formed in the right downward direction. No strain is formed in the hand, the wrist and the arm on either side, and the hand, the wrist and the arm in both hands are in a natural, relaxed posture, so that the tapering operation can be done by simple movement of the body of the operator in the tapering direction while the operator is balancing himself or herself on his or her legs.

This is attained by the particular configuration of the handle portion 3. As shown in FIG. 4A and FIG. 4B, the handle portion 3 to be gripped by the right hand is designed so as to be disposed downstream of the tapering direction as indicated by arrow D with respect to the longitudinal center line 1*m* of the cutting blade portion 1, forming an angle θ2 in the range of $10° \leqq \theta 2 \leqq 40°$ between the longitudinal center line 1 m of the cutting blade portion 1 and the longitudinal center line 3*n* of the handle portion 3, when measured on the plane of the central plane 1*h* of the cutting blade 1*a* (shown in FIG. 5A) which passes through the longitudinal center line 1*f* of the back of the cutting blade 1*a* and the cutting edge 1*b* of the cutting blade 1*a*. For this purpose, it is preferable that the angle θ2 be in the range of $25° \leqq \theta 2 \leqq 35°$, more preferably in the range of $28° \leqq \theta 2 \leqq 33°$.

Furthermore, as mentioned previously, it is preferable that the handle portion 3 have the front surface 3*a* with an angle θ3 in the range of $0° < \theta 3 \leqq 40°$ with respect to the reference plane 1*g* as shown in FIGS. 7A and 7B. This configuration also serves to minimize the strain in the hand, the wrist, and the arm of the operator during the tapering operation. For this purpose, it is more preferable that the angle θ3 be in the range of $10° \leqq \theta 3 \leqq 35°$, furthermore preferably in the range of $20° \leqq \theta 3 \leqq 32°$.

By setting the angle θ2 and the angle θ3 in the above-mentioned respective ranges, the tapering operation in the natural posture, free from any strain in the hand, the wrist and the arm of the operator, can be assured.

Figure 2:
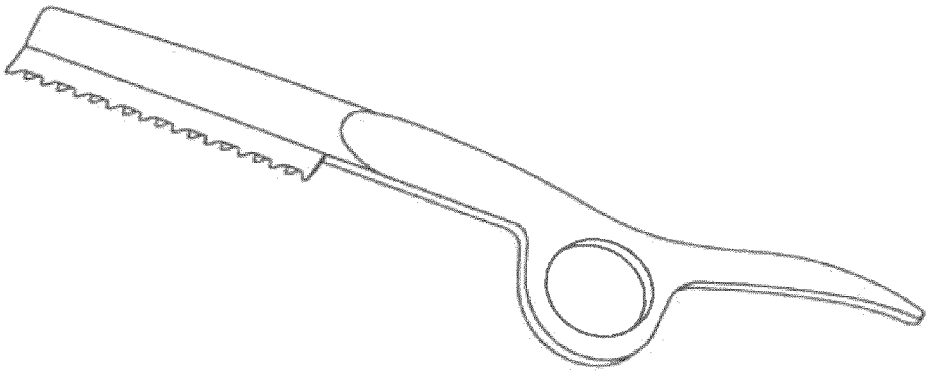
FIG. 2 is a perspective view of a conventional stick-type razor with a disposable blade.
Figure 3A:
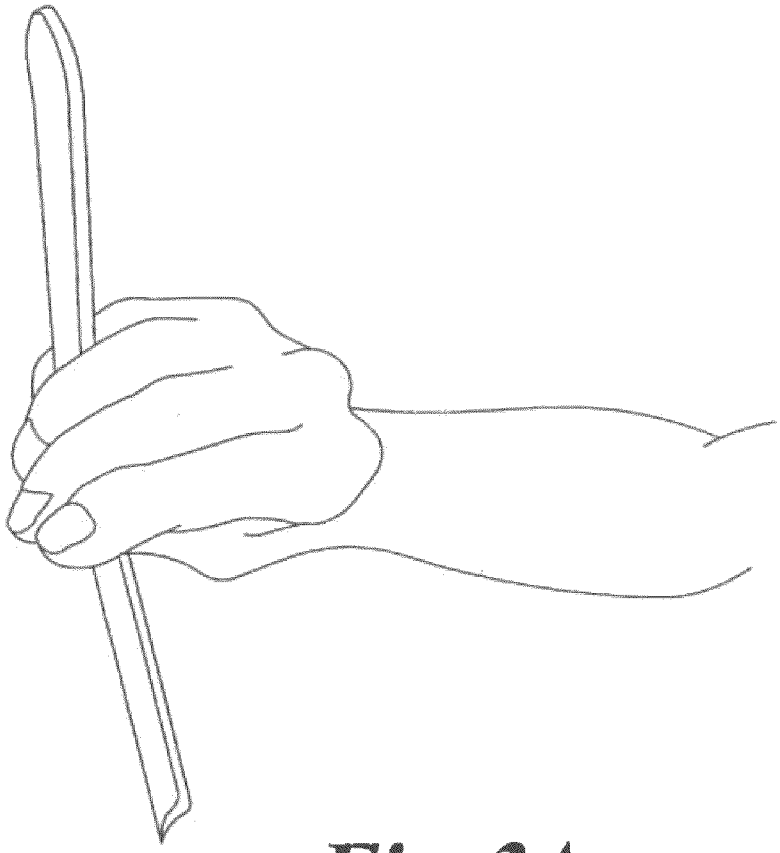
FIG. 3A is a perspective view of a posture of the hand, the wrist and the arm of an operator when the razor shown in FIG. 1 is used.
Figure 3B:
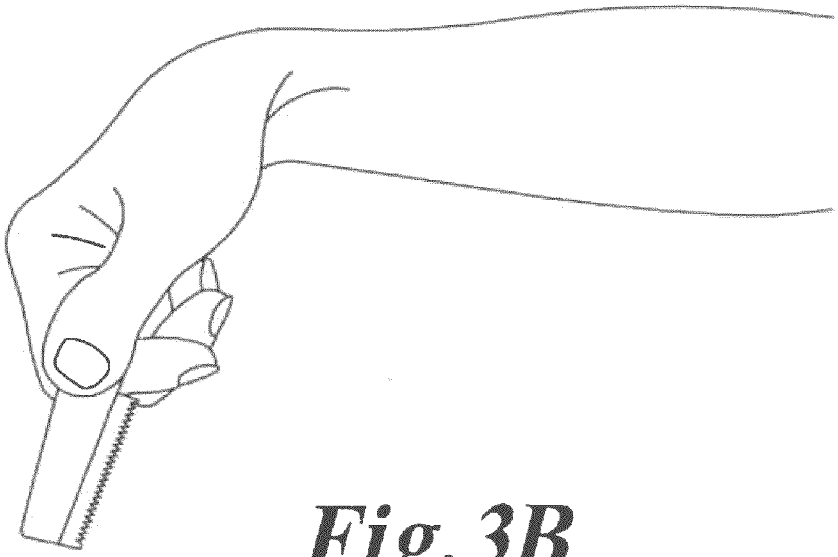
FIG. 3B is a perspective view of a posture of the hand, the wrist and the arm of an operator when the razor shown in FIG. 2 is used.

This means that the inflammation of the tendon sheath, which is known as the disease as the occupational disease of professional hairdressers and is now unavoidable when the razors as shown in FIG. 1 and FIG. 2 are used repeatedly and/or continuously for a long period of time, can be substantially avoided by use of the universal hair tapering razor.

Figure 10D:
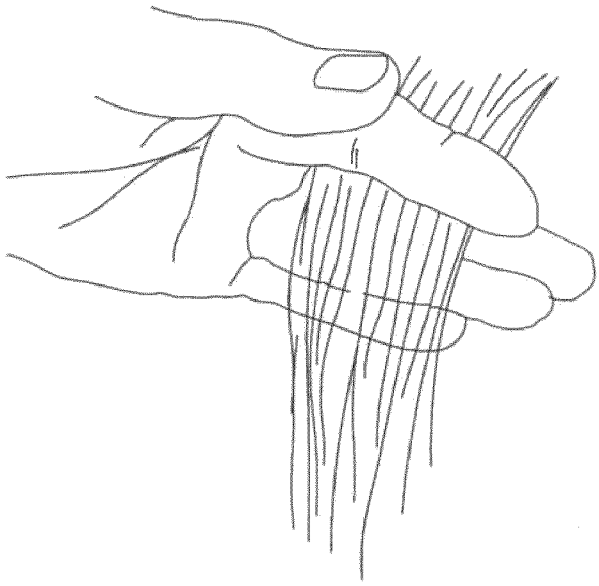
FIG. 10D is a perspective view showing the state of the end portion of the panel of hair tapered by the universal hair tapering razor.

FIG. 10D shows the thus tapered top portion of the hair panel.

Figure 11:
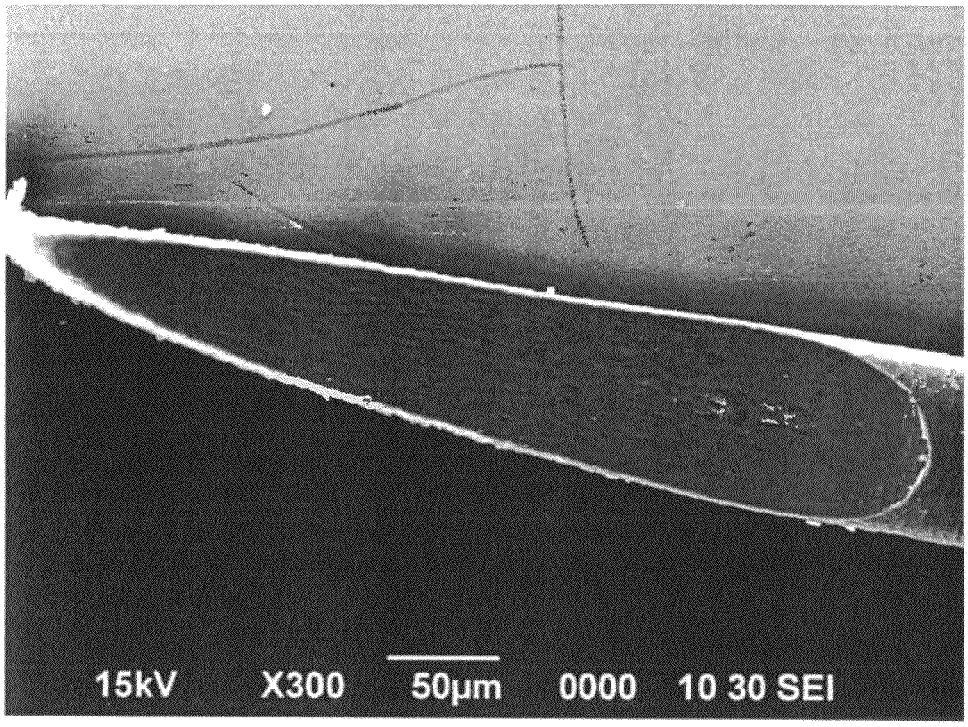
FIG. 11 is an electron microscopic photograph of an end portion of the hair tapered by the universal hair tapering razor.

FIG. 11 is an electron microscopic photograph of an end portion of the hair tapered by the universal hair tapering razor. As can be seen from this electron microscopic photograph, the end portion of the hair is tapered with a constant angle and the tapered cut surface of the hair is smooth.

Figure 12:
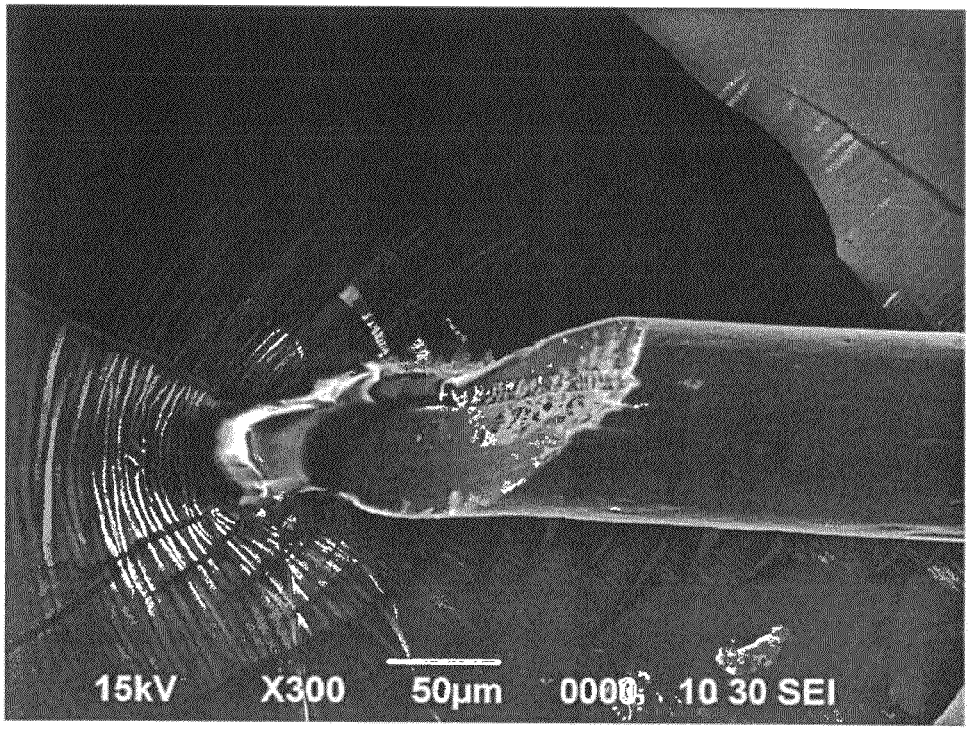
FIG. 12 is an electron microscopic photograph of an end portion of hair tapered by a conventional razor.

FIG. 12 is an electron microscopic photograph of an end portion of hair tapered by a conventional razor. As can be seen from this electron microscopic photograph, the end portion of the hair is not tapered with a constant cut angle and the tapered cut surface of the hair is not smooth, either.

Thus, the universal hair tapering razor can perform the tapering operation, while satisfying the following four indispensable requirements for achieving universal hair tapering that can create two or more different hairstyle as desired from one type of hair tapering:

(1) tapering can be performed with a predetermined constant blade angle to the surface of a panel of hair to be tapered in each stroke of tapering;

(2) each hair can be tapered so as to have a predetermined cut angle at the cut end portion thereof;

(3) each hair can be tapered so as to have a smooth cut surface at the cut end portion thereof; and (4) the above tapering can be performed under the same conditions in any tapering direction to all the hairs on the head, the average overall number of which is as many as about 100,000 on the head.

As mentioned previously, in the universal hair tapering by use of the universal hair tapering razor of the present invention, the above-mentioned hair tapering operation is performed to the entire region on the head to be subjected to a desired hair styling, first either in a right direction or in a left direction as shown in FIG. 9A or FIG. 9B, and then in an opposite direction to the first tapering, that is, either in a left direction or in a right direction.

More specifically, the universal hair tapering method of the present invention that can create two or more different types of hairstyles as desired from one type of hair tapering includes the following steps:

(1) forming a first hair panel in such a manner that the bottom of the first hair panel forms a slanting angle in a range of 35° to 55° with respect to a vertical line, either in a right direction or in a left direction (in the case as shown in FIG. 9A or FIG. 9B, the angle was set at 45°) by making equal the length of each hair in the first hair panel in a tapering direction which is directed from the bottom of the first hair panel to a top thereof;

(2) making uniform the front surface of the first hair panel while applying tension to the first hair panel in the tapering direction;

(3) arranging (a) blade means including a cutting blade that includes a cutting edge for tapering hair by cutting the hair with a predetermined angle and (b) tapering regulating means for regulating hair tapering which allows the cutting edge to come into contact with the front outer surface of the panel of hair to be tapered at predetermined intervals, in parallel with the bottom of the first hair panel, and bringing the cutting blade into close contact with the front outer surface of the first hair panel, and providing, on the back side of the first hair panel, supporting means for supporting the blade means and the tapering regulating means via the first hair panel so as to cause the blade means and the tapering regulating means to operate under a predetermined constant condition during the movement of the blade means and the tapering regulating means;

(4) moving the cutting blade means in the tapering direction from the bottom of the first hair panel to the top thereof, with the cutting edge kept in close contact with the front surface of the first hair panel with an angle of θ1 slanting in a range of 0°<θ1≦40° with respect to the front surface of the first hair panel, when measured in a direction normal to a longitudinal direction of the cutting edge of the cutting blade, thereby tapering each hair with a constant cutting angle and a smooth cut surface;

(5) forming a plurality of hair panels successively, with the bottom of each hair panel being set in parallel to the bottom of the first hair panel, in the same manner and in the same direction as that of the first hair panel so as to cover an entire hairstyling region to be subjected to a desired hair styling, while performing the same steps as the steps (1) to (4) for each of the hair panels;

(6) forming a second hair panel in such a manner that the bottom of the second hair panel forms a slanting angle in a range of from 35° to 55° with respect to a vertical line in an opposite direction to the direction of the bottom of the first hair panel in the same manner as in step (1); and (7) forming a plurality of hair panels successively, with the bottom of each hair panel being set in parallel to the bottom of the second hair panel, in the same manner and in the same direction as that of the second hair panel so as to cover the entire hairstyling region, while performing the same steps as the steps (1) to (4) for each of the hair panels.

In the above-mentioned universal hair tapering method, it is preferable that the angle θ1 be in the range of 10°≦θ1≦35°, more preferably in the range of 20°≦θ1≦32°, further more preferably in the range of 28.5°≦θ1≦29.5°.

Figure 14A:
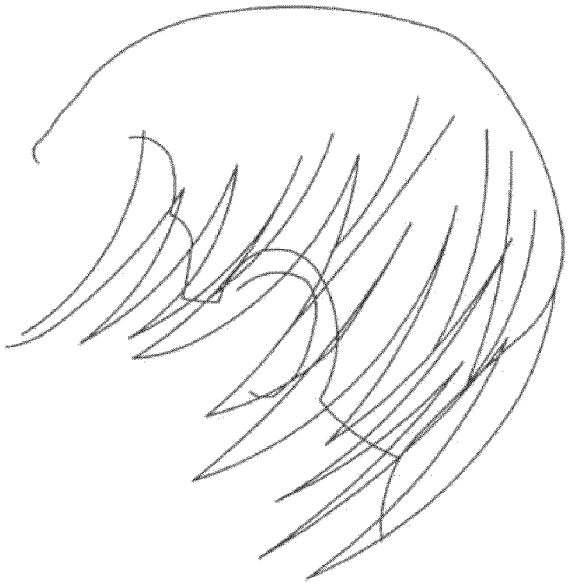
FIGS. 14A, 14B and 14C are schematic views of various hairstyles created as desired from the single universal hair tapering conducted by the universal hair tapering razor, showing that the thus tapered hair can be combed and set in any direction as desired.
Figure 14B:
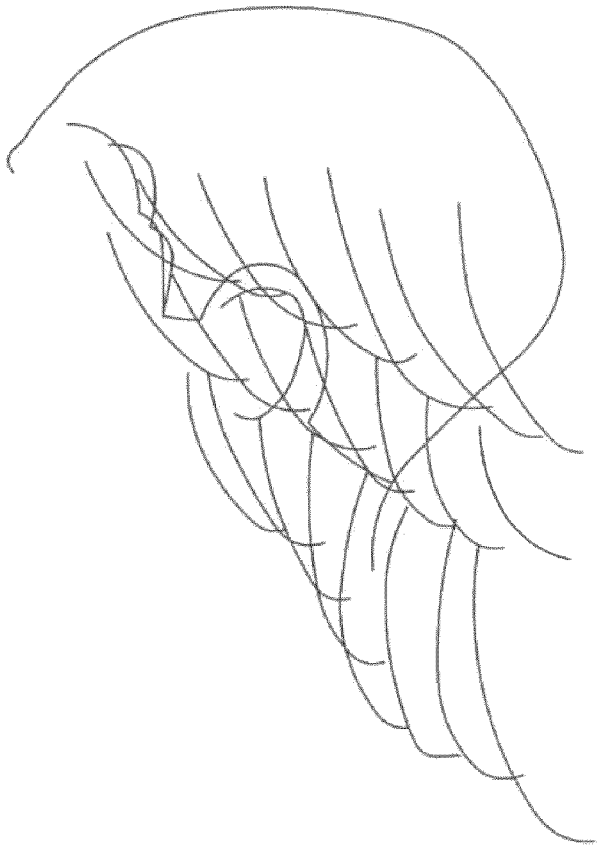
Figure 14C:
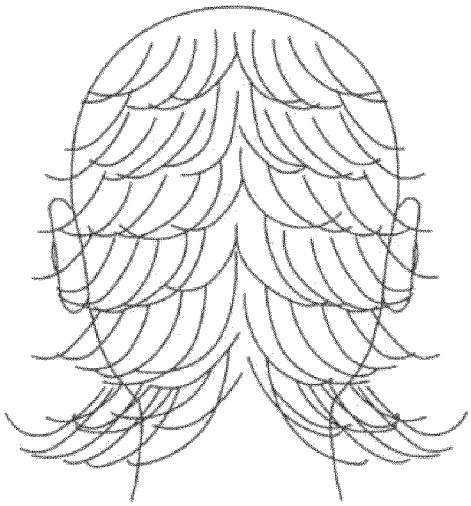

When such tapering operation is performed with each hair panel HP so as to cover an entire region for a desired hair styling, the top of each tapered hair panel HP are arrayed on a smooth continuous line as shown in FIG. 13. Furthermore, once such tapering operation has been performed, the tapered hair can be directed in any direction and various hairstyles as shown in FIG. 14A through FIG. 14C can be created as desired. The above-mentioned universal hair tapering method can be securely performed by use of the universal hair tapering razor of the present invention.

Any of the above-described inventions is not limited to the specifically disclosed embodiments, and variations and modifications may be made without departing from the scope of the invention.

The entire disclosure of Japanese Patent Application No. 2009-123410 filed on May 21, 2009 including specification, claims, drawings and summary is incorporated herein by reference in its entirety.

The invention claimed is:

1. A universal hair tapering razor for tapering hair comprising:

a cutting blade portion;

a shank portion connected to one end of said cutting blade portion; and a handle portion connected to said cutting blade portion via said shank portion, wherein said cutting blade portion includes blade means including a cutting blade that includes a cutting edge for tapering hair by cutting the hair with a predetermined angle, which cutting blade is configured to stroke a panel of hair in a direction of hair growth, which is referred to as the hair tapering direction;

tapering regulating means for regulating hair tapering including a tapering regulating member disposed along said cutting edge, with a plurality of projecting edges projecting out over said cutting edge at predetermined intervals for allowing said cutting edge to come into contact with the hair to be tapered at the predetermined intervals corresponding to said projecting edges; and blade holding means for holding said cutting blade, said blade holding means comprising a flat portion that extends in parallel with said cutting edge in the longitudinal direction thereof and configured to be brought into close contact with the panel of hair to be tapered, with both said cutting edge of said cutting blade and the outer surface of said flat portion being configured so as to be on an identical reference plane, wherein an angle θ1 of said cutting blade with respect to said reference plane is defined as an angle directed from said reference plane to a central plane that passes through a longitudinal center line of a back of said cutting blade and said cutting edge thereof, measured upstream of said hair tapering direction with respect to said cutting blade portion, in a direction normal to said cutting edge of said cutting blade, and the angle θ1 of said cutting blade is in the range of 0°<θ1≦40°; and said handle portion is disposed so as to be directed downstream of said tapering direction, forming an angle θ2 in a range of 10°≦θ2≦40° between a longitudinal center line of said cutting blade portion and a longitudinal center line of said handle portion, when measured on the central plane of said cutting blade that passes through the longitudinal center line of the back of said cutting blade and said cutting edge of the cutting blade, said blade holding means further comprises a datum shoulder portion and a counterpart shoulder portion, wherein the two shoulder portions are disposed so as to face other at said central plane of said cutting blade and integrally hold therebetween said blade means and said tapering regulating means, and said datum shoulder portion comprises said flat portion; and said handle portion comprises a flat surface portion on the same side as that of said counterpart shoulder portion, which flat surface portion of said handle portion slants, forming an angle θ3 in the range of 0°<θ3≦40° with said reference plane when measured upstream of said hair tapering direction with respect to said cutting blade portion, in the direction normal to the cutting edge of the cutting blade.

2. The universal hair tapering razor as claimed in claim 1, wherein said angle θ1 is in the range of 10°≦θ1≦35°.

3. The universal hair tapering razor as claimed in claim 2, wherein said angle θ1 is in the range of 20°≦θ1≦32°.

4. The universal hair tapering razor as claimed in claim 3, wherein said angle θ1 is in the range of 28.5°≦θ1≦29.5°.

5. The universal hair tapering razor as claimed in claim 1, wherein said angle θ2 is in the range of 25°≦θ2≦35°.

6. The universal hair tapering razor as claimed in claim 5, wherein said angle θ2 is in the range of 28°≦θ2≦33°.

7. The universal hair tapering razor as claimed in claim 1, wherein said angle θ3 is in the range of 10°≦θ3≦35°.

8. The universal hair tapering razor as claimed in claim 7, wherein said angle θ3 is in the range of 20°≦θ3≦32°.

9. The universal hair tapering razor as claimed in claim 1, wherein said blade means and said tapering regulating means are detachable from said datum shoulder portion and said counterpart shoulder portion.

10. A universal hair tapering method for tapering hair comprising the steps of:

(1) forming a first hair panel in such a manner that the bottom of said first hair panel forms a slanting angle in a range of 35° to 55° with respect to a vertical line, either in a right direction or in a left direction by making equal the length of each hair in said first hair panel in a tapering direction which is directed from the bottom of said first hair panel to a top thereof;

(2) making uniform a front surface of said first hair panel while applying tension to said first hair panel in said tapering direction;

(3) arranging (a) blade means including a cutting blade that includes a cutting edge for tapering hair by cutting the hair with a predetermined angle and (b) tapering regulating means for regulating hair tapering which allows said cutting edge to come into contact with said front surface of said first hair panel to be tapered at predetermined intervals, in parallel with the bottom of the first hair panel, and bringing said cutting blade into close contact with said front surface of said first hair panel, and providing, on the back side of said first hair panel, supporting means for supporting said blade means and said tapering regulating means via said first hair panel so as to cause said blade means and said tapering regulating means to operate under a predetermined constant condition during the movement of said blade means and said tapering regulating means;

(4) moving said cutting blade means in said tapering direction from said bottom of said first hair panel to the top thereof, with said cutting edge kept in close contact with said front surface of said first hair panel with an angle of $\theta 1$ slanting in a range of $0° < \theta 1 \leqq 40°$ with respect to the surface of said first hair panel when measured in a direction normal to a longitudinal direction of said cutting edge of said cutting blade, thereby tapering each hair with a constant cutting angle and a smooth cut surface;

(5) forming a plurality of hair panels successively, with the bottom of each hair panel being set in parallel to the bottom of said first hair panel, in the same manner and in the same direction as that of said first hair panel so as to cover an entire hairstyling region to be subjected to a desired hair styling, while performing the same steps as the steps (1) to (4) for each of said plurality of hair panels;

(6) forming a second hair panel in such a manner that the bottom of said second hair panel forms a slanting angle in a range of 35° to 55° with respect to a vertical line in an opposite direction to the direction of the bottom of said first hair panel in the same manner as in step (1); and (7) forming a plurality of hair panels successively, with the bottom of each hair panel being set in parallel to the bottom of said second hair panel, in the same manner and in the same direction as that of said second hair panel so as to cover the entire hairstyling region, while performing the same steps as the steps (1) to (4) for each of the hair panels.

11. The universal hair tapering method as claimed in claim 10, wherein said angle $\theta 1$ is in the range of $10° \leqq \theta 1 \leqq 35°$.

12. The universal hair tapering as claimed in claim 11, wherein said angle $\theta 1$ is in the range of $20° \leqq \theta 1 \leqq 32°$.

13. The universal hair tapering method as claimed in claim 12, wherein the angle $\theta 1$ is in the range of $28.5° \leqq \theta 1 \leqq 29.5°$.

* * * * *